US007157894B2

(12) United States Patent
Fulton et al.

(10) Patent No.: US 7,157,894 B2
(45) Date of Patent: Jan. 2, 2007

(54) LOW POWER START-UP CIRCUIT FOR CURRENT MIRROR BASED REFERENCE GENERATORS

(75) Inventors: Robert Fulton, Folsom, CA (US); Andrew Volk, Granite Bay, CA (US); Chinnugounder Senthilkumar, Folsom, CA (US)

(73) Assignee: Intel Corporation, Santa Clara, CA (US)

( * ) Notice: Subject to any disclaimer, the term of this patent is extended or adjusted under 35 U.S.C. 154(b) by 348 days.

(21) Appl. No.: 10/331,390

(22) Filed: Dec. 30, 2002

(65) Prior Publication Data

US 2004/0124823 A1 Jul. 1, 2004

(51) Int. Cl.
*G05F 3/20* (2006.01)

(52) U.S. Cl. ..... 323/315

(58) Field of Classification Search ..... 323/312, 323/313, 315; 327/538, 540, 543
See application file for complete search history.

(56) References Cited

U.S. PATENT DOCUMENTS 5,914,868 A * 6/1999 Han et al. ..... 363/60
6,002,245 A * 12/1999 Sauer ..... 323/315
6,191,662 B1 2/2001 Volk
6,229,382 B1 * 5/2001 Kojima ..... 327/538
6,400,185 B1 * 6/2002 Pavan ..... 327/543
6,563,295 B1 * 5/2003 Juang ..... 323/315
6,600,303 B1 * 7/2003 Ikehashi ..... 323/315
2003/0122629 A1 7/2003 Fulton et al.

* cited by examiner

*Primary Examiner*—Gary L Laxton
(74) *Attorney, Agent, or Firm*—Blakely, Sokoloff, Taylor & Zafman LLP

(57) ABSTRACT

Start-up circuit for current mirror circuits to facilitate transition from a zero-current state to an operation state. The start-up circuit includes two sets of current control devices. A set is coupled to each leg of the current mirrored circuit to provide a bias on start-up. The current control devices are coupled together to mirror the current that continues during the operational state such that the start-up circuit in combination with the operating circuit do not draw more current in the operational state than the operating circuit would normally draw in the operational state.

13 Claims, 6 Drawing Sheets

LOW POWER START-UP CIRCUIT FOR CURRENT MIRROR BASED REFERENCE GENERATORS

BACKGROUND (1) Field of the Invention

The invention relates to reference generating circuits. Specifically, a circuit for providing start-up power to current mirror based reference generator.

(2) Background

Modern computer systems and electronic devices frequently include circuits that require a start-up power source in order to either "kick" a circuit out of a zero current state or to hasten the circuit's power-up process. Faster start-up of key circuits like oscillators and power conversion circuits decreases the wait time for a user upon starting a device or waking the device from a low power state.

Computer systems and electronic devices have increasingly been designed for portability including the advent of such devices as laptop computers, handheld computers, Personal Digital Assistants (PDAs) and similar devices that rely on batteries for a significant part of their power. Therefore, it has become increasingly important that start-up circuits also minimize the amount of power consumed during the start up sequence and afterward by minimizing power consumption or inefficiencies caused by the extra circuitry required to implement the start-up circuit.

When batteries are inserted or other power sources are first connected to a device, components such as oscillators require a reliable initial voltage or current to be supplied to the component in order to ensure that the component can successfully transition from a zero-current state to a steady state of operation. Further, the kick-start circuit must not subsequently attempt to provide a kick-start to a circuit that has reached its steady state because this would be likely to cause erratic behavior in an important component. For example, if an oscillator received a kick-start while in normal operation an unreliable clock signal might result which would destabilize the entire system.

Current start-up systems require excess circuitry in order to accomplish the task of preparing a system for normal operation. Many systems like oscillator circuits produce unreliable or spurious output during the start-up phase. This requires circuits that rely on the output of oscillation circuits to have additional circuitry to filter out the initial unreliable signals. This is often accomplished by waiting or 'counting' for a period of time after start-up until it is known that a required component will have successfully started and will provide a reliable signal. This requires extra circuitry to implement, consumes additional power and involves a significant delay. Circuits that kick-start a circuit by supplying an initial bias to the circuit often include circuitry to sense the state of the circuit to be biased and to shut off that bias when the circuit reaches a certain threshold. Implementing this wait or counting operation requires extra circuitry in order to detect the state of a circuit and to cut off the bias source from that circuit. This extra circuitry consumes additional power that shortens the life span of a battery or similar power supply.

BRIEF DESCRIPTION OF THE DRAWINGS

Embodiments of the invention are illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

DETAILED DESCRIPTION

Figure 1:
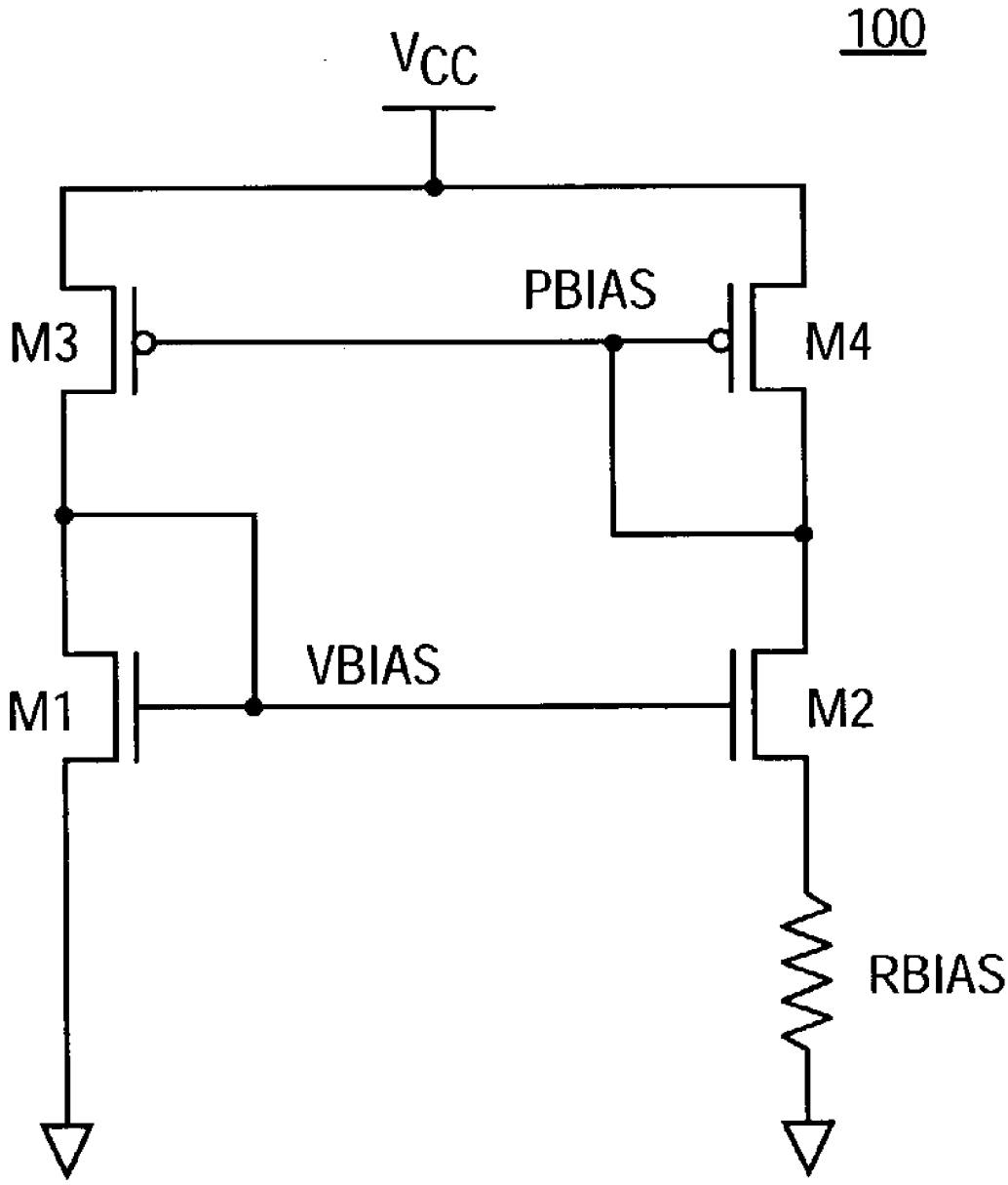
FIG. 1 (PRIOR ART)
FIG. 1 is a circuit diagram of a self-bias circuit.

FIG. 1 is a diagram of a conventional self-bias circuit 100. This circuit generates reference signals Pbias and Vbias. These reference signals can be used to mirror currents in other circuits such as an oscillator circuit or power conversion circuit. Circuits such as self-bias circuit 100 maintain constant currents when in a steady state. However, on start-up when there is a zero-current state in self-bias circuit 100 a deadlock occurs preventing the circuit from reaching a steady state. In self-bias circuit 100, without a start-up circuit, the current through the left leg, including devices M3 and M1, and the current through the right leg, including devices M4 and M2 is zero. The signal Vbias starts at ground potential upon start-up. The signal Pbias starts at Vcc potential upon start-up. These initial conditions reinforce themselves around the feedback loop of self-bias circuit 100. Self-bias circuit 100 becomes deadlocked in this state and is thereby prevented from transitioning from a zero-current state to a steady state. Self-bias circuit 100 therefore cannot produce the stable signals Pbias and Vbias that are required by other components.

Figure 2:
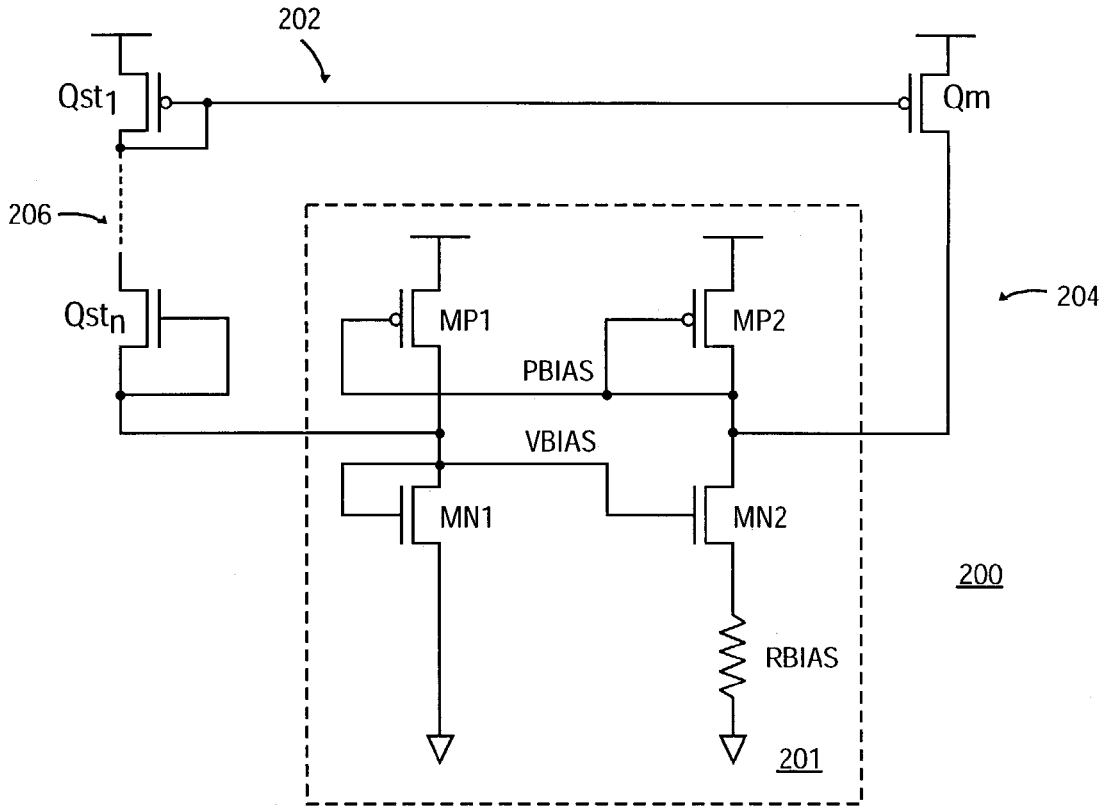
FIG. 2 is an improved self-bias circuit with a kick-start circuit.

FIG. 2 is a circuit diagram of a self-bias circuit 201 coupled to an improved start-up circuit 202 to form an aggregate circuit 200. In one embodiment, the start-up circuit 202 consists of a right leg 204 that is attached to a leg of self-bias circuit 201 and a left leg 206 that is attached to the other leg of self-bias circuit 201. In one embodiment, right leg 204 includes at least one current control device Qm. In another embodiment, the left leg 206 includes a set of current control devices $Qst_1$–$Qst_n$ each with their control input tied to their outputs (e.g., the transistor gate of $Qst_1$ is tied to its drain). The current through the Qm leg 204 is a mirror of the $Qst_1$ leg 206 current. This mirroring allows the start-up circuit 202 to be transparent (i.e., the start-up circuit 202 does not cause the combined circuit to draw extra current above what the self-bias circuit 201 would draw alone) after transition into steady state operation. In one embodiment Qm and $Qst_1$ are transistors, which could be CMOS or BJT. In one embodiment, left leg 206 includes at least one current control device $Qst_1$. In one embodiment, devices $Qst_2$ through $Qst_n$ can be a diode, transistor, resistor or similar device. These devices are used as current-limiters that are designed to keep the steady state current less than the total amount of current that device MN1 is designed to draw in steady state.

In one embodiment, start-up circuit 202 adds sufficient current to self-bias circuit 201 until it has sufficiently started and approached its steady state. When the Pbias and Vbias signals approach their steady state levels, start-up circuit 202 is no longer needed to contribute current to self-bias circuit 201. The greater the degree of transparency (i.e., the smaller the affect of start-up circuit 202 on self-bias circuit 201) after the start-up has succeeded the more highly tuned self-bias circuit 201 can be. If a start-up circuit continues to contribute significant current levels that force the current above the desired steady state current level for Pbias and Vbias then self-bias circuit 201 cannot provide the intended reference signals to other components and damage to self-bias circuit components may result. Likewise, if a start-up circuit provides erratic current levels to self-bias circuit 201 then self-bias circuit 201 cannot provide as consistent or accurate a Pbias or Vbias signal to other components. Also, if a start-up circuit continues to draw significant amounts of current after reaching a steady state then power consumption is increased and consequently battery life will be decreased. In one embodiment, start-up circuit 202 is completely transparent and functions in coordination with self-bias circuit 201 to provide reliable and predictable reference signals. In one embodiment, self-bias circuit 201 used in conjunction with start-up circuit 202 operates in with a current in the sub-microampere range. In one embodiment, self-bias circuit 201 and start-up circuit 202 operate with a current as small as 50 nano-amperes. Start-up circuit 202 operates in a bias independent manner. This bias independent operation allows start-up circuit 202 to operate in conjunction with most types of current mirrored circuits with zero-current start-up states without modifications to the basic design and without affecting the operation of the circuit needing start-up. Further, because of the transparent operation of start-up circuit 202 in a steady state, the aggregate circuit 200 formed of self-bias circuit 201 and start-up circuit 202 does not draw any additional current over what self-bias circuit 100 normally draws.

In one embodiment, the current needed to start self-bias circuit 201 is provided through devices $Qst_1$–$Qst_n$ and through the device MN1. Current flowing through $Qst_1$–$Qst_n$ and M1 generates a non-zero Vbias level. A non-zero Vbias level allows current to flow through device MN2. In one embodiment, current through MN2 will be drawn through Qm. In one embodiment, Qm has the same device size ratio to $Qst_1$ that devices MP1 and MP2 have to one another. Maintaining this ratio ensures that start-up circuit 202 does not introduce asymmetrical currents into self-bias circuit 201. Qm and $Qst_1$ will provide currents to each leg of self-bias circuit 201 in the ratio established by MP1 and MP2 in order that reference operating levels for which self-bias circuit 201 is designed for are not affected. Current through the $Qst_1$–$Qst_n$ and MN1 path increases on start-up. This increase results in a decrease of Pbias level. A decrease in the Pbias level results in MP2 being turned 'on.' Current then begins to flow through MP1 to join with the current provided by $Qst_1$–$Qst_n$. These current levels continue to increase until they reach the desired operating levels. In one embodiment, when the self-bias circuit 201 reaches a steady state, the sum of the currents through devices Qst1 and MP1 is equal to the current through the M3 device of circuit 100. Similarly, the sum of the currents through devices MP2 and Qm is equal to the current through the M4 device of circuit 100.

In one embodiment, the number of devices $Qst_1$–$Qst_n$, as well as the size of the devices are chosen such that the device-voltage divider effect created between the start-up devices (i.e., $Qst_1$ through $Qst_n$ and Qm) and the reference load devices creates a sufficient Vbias level to start-up self-bias generating circuit 201 without exceeding the total current draw from the MP1 and MP2 devices during normal operation. The current needed for start-up is typically a fraction of the total required current during steady state conditions. In one embodiment, each current controlling device (e.g., Qst1) reduces the current from Vcc by a predictable amount dependent on the type of device used, process of manufacturing the device, dimensions of the device and its characteristics. The current draw from the current control devices must be such that the resulting current level input into self-bias circuit 201 is less than the reference level that self-bias circuit 201 is designed to produce. Start-up circuit 202 improves the process-voltage-temperature (PVT) tolerance of self-bias circuit 201, because it regulates the current in cooperation with self-bias circuit 201. This results in improved accuracy and producing constant current levels in contrast to other start-up mechanisms that supply fixed voltage or current levels. Thus, variations in PVT are compensated for in the transparent design of start-up circuit 202.

Figure 3:
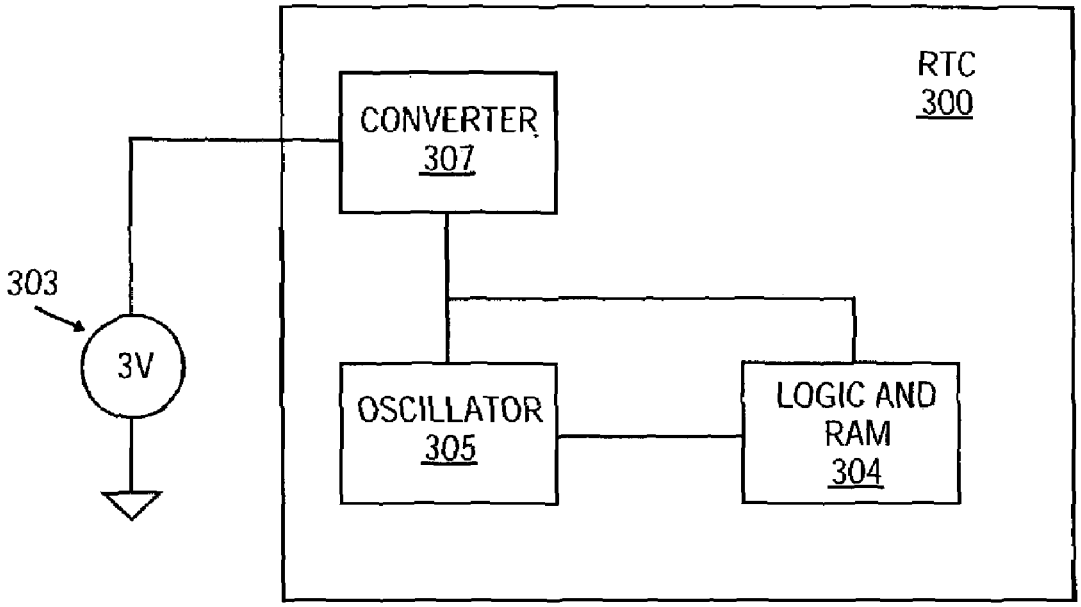
FIG. 3 is a block diagram of a real time clock (RTC).

FIG. 3 is a block diagram of one embodiment where start-up circuit 202 is used as part of a real time clock (RTC) component 300. In one embodiment, RTC 300 draws power from a battery 303 when the system is not connected to an external power supply. In one embodiment, battery 303 is a 3 volt cell battery. In another embodiment, the RTC draws power from a capacitor or similar device. In one embodiment, the capacitor is a one farad capacitor.

In one embodiment, RTC 300 includes a direct current (DC) to DC power converter 307. Power converter 307 converts the 3 volt power source to the voltage level required by other components of RTC 300. RTC 300 also includes an oscillator circuit 305 that produces a square wave clock signal based on input from an off die piezoelectric crystal. In one embodiment, oscillator circuit 305 includes a self-bias circuit 201 that supports current mirroring to an amplifier and duty cycle tuning circuit within oscillator circuit 305. Oscillator circuit 305 includes a start-up circuit 202 to kick-start oscillator circuit 305 from a zero-current state to a steady state. In one embodiment, oscillator circuit 305 including self-bias circuit 201 will be in a zero-current state before a battery 303 is inserted or replaced.

In one embodiment, RTC 300 includes logic and memory components 309 that store information such as actual time and enable functions such as setting and maintaining the actual time. In one embodiment, logic and memory components 309 store data and functions that are used during start-up, recovery or when primary power is unavailable. In one embodiment, memory 309 stores basic input output system (BIOS) information, wake up information and functions, soft reboot information, alarm functions and similar data and instructions. Logic and memory components 309 are driven by the output clock signal from oscillator circuit 305 and powered by power conversion circuit 307.

Figure 4:
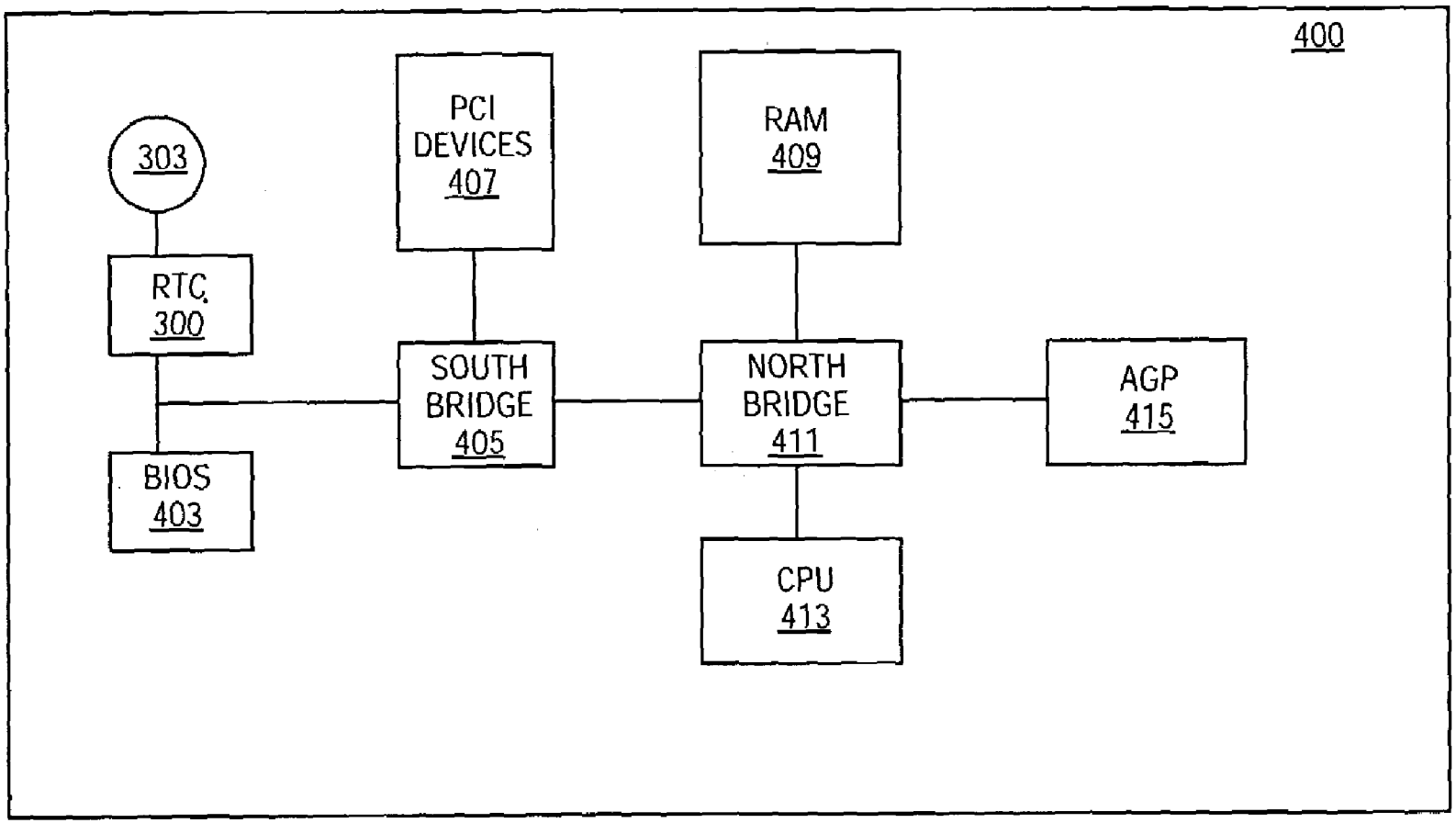
FIG. 4 is a block diagram of a motherboard including an RTC.

FIG. 4 is a block diagram of a motherboard 400 of a computer system. In one embodiment, the motherboard includes a backup power source 303. In one embodiment, backup power source 303 can be a cell battery, capacitor or similar component. The backup power source is connected to an RTC 300 and BIOS 403 device. RTC 300 and BIOS 403 maintain system information necessary for the system to maintain when it is disconnected from its primary power source (e.g., actual time, processor clock speed, fixed disk properties, and similar information). In one embodiment, RTC 300 includes a start-up circuit 202 coupled to an oscillator circuit 305. PCI devices 407 are managed by a I/O controller hub (a "south bridge") 405. In one embodiment, south bridge 405 may also handle the RTC and BIOS. In one embodiment, RTC 300 is on die with south bridge 405. North bridge 411 manages communication on the bus system connecting the random access memory (RAM) 409, the central processing unit (CPU) 413. Other components that need to have a fast connection with CPU 413 or memory 409 such as an advanced graphics port device 415 are also connected with north bridge 411.

Figure 5:
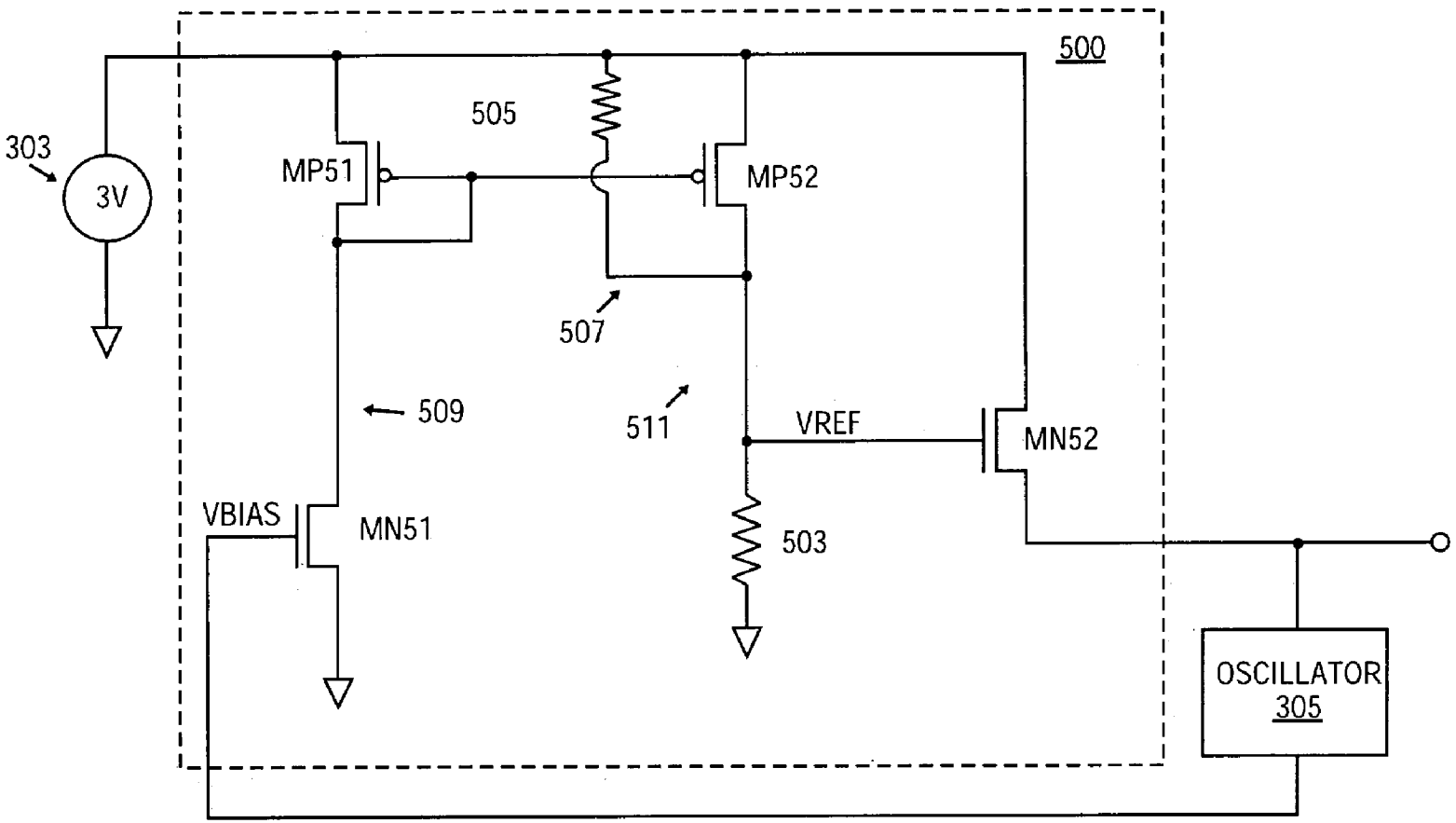
FIG. 5 (PRIOR ART)
FIG. 5 is a circuit diagram of a power converter circuit.

FIG. 5 is a circuit diagram of a typical power conversion circuit that relies on the signal Vbias as a current mirror reference from oscillator circuit 305. Power conversion circuit 500 controls the current from backup power source 303 by generating a voltage reference VREF. The value of VREF is determined by the size of transistors MP51, MP52, MN51 and MN52 and the values of resistor 503. In one embodiment, transistors or similar current controlling devices replaces resistor 503. Power conversion circuit 500 would deadlock on start up without conductor 507 and resistor 505. This connection provides a minimum voltage for VREF on start-up that allows oscillator circuit 305 to start and thereby to provide the Vbias signal. The Vbias signal then enables power conversion circuit 500 to reach a steady state by allowing current to flow through leg 509. However, this circuit does not produce a predictable VREF and output voltage because the connection 507 with resistor 505 introduces an asymmetry between left leg 509 and right leg 511 of the conversion circuit 500. Also, connection 507 draws additional current from power source 303 that is not needed in the circuit 500 further skewing the VREF signal and output voltage.

Figure 6:
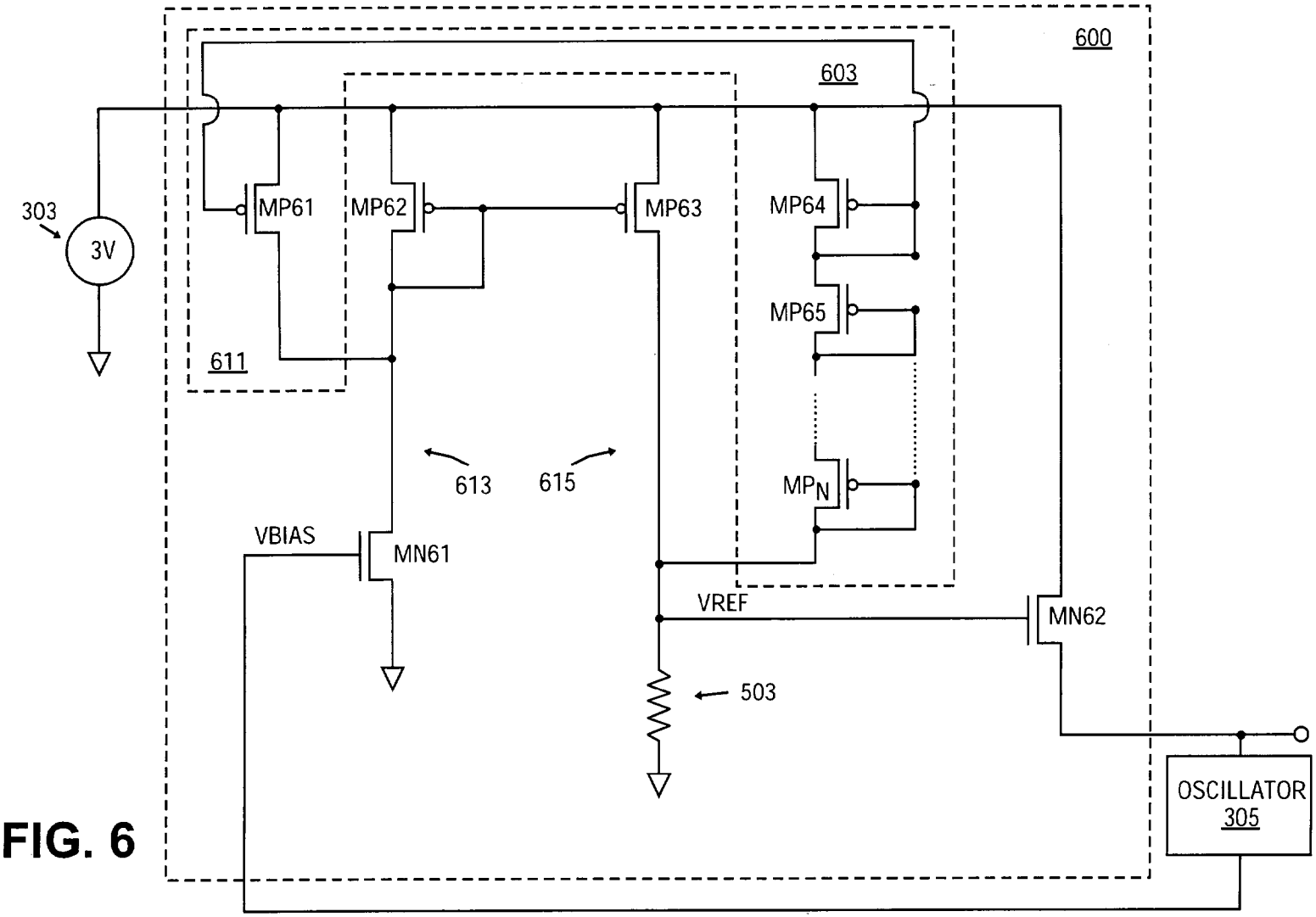
FIG. 6 is a circuit diagram of an improved power converter circuit.

FIG. 6 is a circuit diagram of an improved power conversion circuit 600 including a start-up circuit 603. In one embodiment, current control devices MP62, MP63, and MN61 in combination with biasing resistor 503 generate a VREF signal that drives device MN62 to regulate power to oscillator circuit 305 and other devices. Start-up circuit 603 consists of current control devices MP61 and MP64 through MPn. In one embodiment, current control devices MP65-MPn can be transistors, diodes or similar components. In one embodiment, devices MP61 and MP64 are transistors to provide a current mirror so that the current in the two legs can be controlled in line with a desired ratio. Devices MP64 through MPn provide an initial minimal voltage for VREF. In one embodiment, this enables the oscillator circuit 305 to produce a Vbias signal. The Vbias signal opens device MN61 enabling current to flow through devices MP62 and MN61 and as a result MP63. In one embodiment, improved power converter circuit 603 can reach a steady state once it receives the Vbias signal. Start-up circuit 603 reduces its current flow as power conversion circuit 600 reaches a steady state. Further, start-up circuit 603 has a symmetrical affect on each leg 613 and 615 of power conversion circuit 600. In one embodiment, the level of current provided by start-up circuit 603 is dynamically controlled by the level of current being driven through MN62 by VREF. This allows start-up circuit 603 to operate in a transparent fashion when power conversion circuit 600 is in a steady state. In one embodiment, start-up circuit 603 operates in conjunction with devices MP62, MP63 and MN61 to create a predictable VREF signal based on known device sizes of MP61 through MPn, MN61 and resistor 503. Thus, start-up circuit 603 does not draw significant additional power when power conversion circuit 600 is in a steady state, thereby extending the life of power supply 303. In one embodiment, when the power conversion circuit 600 reaches a steady state, the sum of the currents through current control devices MP61 and MP62 is equal to the current through the current control device MP51 of power conversion circuit 500. Similarly, the sum of the currents through devices MP64 and MP63 of power conversion circuit 600 is equal to the current through device MP52 of power conversion circuit 500.

In one exemplary embodiment, to generate a 1.2 volt output a 4 megaOhm resistor 503 is used. Devices MP61 through MP65 are PMOS transistors and devices MN61 and MN62 are NMOS transistors. Power source 303 is a 3 volt battery. On start from a zero-current state, transistors MP64 and MP65 allow a 0.2 microampere current flow through the right leg of start-up circuit 603. An identical 0.2 microampere current is created across transistor MP61. Vbias level on start-up from the initial zero-current state is 0 volts allowing no current through transistor MN61. As a result, there is no current across transistor MP62. The current through MP64 and MP65 generates a 0.8 volt output. In one embodiment, this output voltage is sufficient to start oscillator circuit 305 that generates a Vbias level. The Vbias signal creates a current across MN61 at 0.3 microamperes. The current is drawn from power supply 303 and divided over MP61 at 0.05 microamperes and over MP62 at 0.25 microamperes. MP63 is also driven by the same control input as MP62 to draw 0.25 microamperes. MP64 and MP65 draw 0.05 microamperes. As a result VREF generates a 1.2 volt output.

In the foregoing specification, the invention has been described with reference to specific embodiments thereof. It will, however, be evident that various modifications and changes can be made thereto without departing from the broader spirit and scope of the invention as set forth in the appended claims. Modifications based on the use of different components and alternate topologies for exemplary circuits can be made consistent with the spirit and scope of the invention. The specification and drawings are, accordingly, to be regarded in an illustrative rather than a restrictive sense.

What is claimed is:

1. An apparatus comprising:

a first current mirror circuit having at least a first leg and a second leg to deliver first and second mirrored currents to first and second nodes, respectively;

a first startup component to deliver a first bias-independent startup current to the first node;

a second startup component to deliver a second bias-independent startup current to the second node; and a second current mirror circuit having at least a first leg to sink a first total current from the first node and a second leg to sink a second total current from the second node; wherein a ratio between the first mirrored current and the second mirrored current is equal to a ratio between the first startup current and the second startup current.

2. The apparatus of claim 1 further comprising:

a plurality of current control components connected in series with the second startup component.

3. The apparatus of claim 1, wherein the first startup component is a transistor.

4. The apparatus of claim 1, wherein the second startup component is a transistor.

5. The apparatus of claim 2, wherein each component of the plurality of current control components is a field effect transistor with its gate coupled to its source.

6. The apparatus of claim 1, wherein at least one of the first node and the second node provides a stable, bias-independent reference voltage.

7. The apparatus of claim 1, wherein the current mirror circuit is a voltage control circuit.

8. A method comprising:

supplying a first bias-independent current level to a first leg of a circuit when power is applied to the circuit;

supplying a second bias-independent current level to the first leg and a second leg of the circuit when the circuit reaches a steady state after power is applied; and generating a reference voltage between the first leg and second leg, wherein the first current level is less than the second current level and the second current level maintains a ratio of current level between the first and second leg.

9. The method of claim 8, wherein the total current level of the first leg, second leg and startup circuit is approximately 50 nano-amperes.

10. The method of claim 8, further comprising:

supplying the first current to the second leg of the circuit to transition the circuit to a steady state from a zero-current state.

11. A self-bias circuit comprising:

a first current mirror to deliver a first mirrored current to a first node and a second mirrored current to a second node;

a second current mirror to sink a first total current delivered to the first node and a second total current delivered to the second node;

a first startup component to deliver a first bias-independent startup current to the first node; and a second startup component to deliver a second bias-independent startup current to the second node; wherein the first startup current is less than a steady-state current sunk from the first node; and the second startup current is less than a steady-state current sunk from the second node.

12. The self-bias circuit of claim 11, wherein a ratio of the first startup current to the second startup current is equal to a ratio of the first mirrored current to the second mirrored current.

13. The self-bias circuit of claim 11, wherein at least one of the first node and the second node provides a bias-independent reference voltage.

* * * * *